United States Patent [19]

Marynissen

[11] 4,036,579

[45] July 19, 1977

[54] LIGHTER

[75] Inventor: William E. Marynissen, Old Greenwich, Conn.

[73] Assignee: Bic Pen Corporation, Milford, Conn.

[21] Appl. No.: 573,384

[22] Filed: Apr. 30, 1975

[51] Int. Cl.[2] ..... F23Q 2/08; F23Q 25/00; F23Q 1/02

[52] U.S. Cl. ..... 431/131; 431/150; 431/277

[58] Field of Search ..... 431/277, 130, 131, 150, 431/142, 143, 255, 27 C, 344; 74/10.41; 85/8.6; 151/53

[56] References Cited

U.S. PATENT DOCUMENTS

| | | | |
|---|---|---|---|
| 3,280,599 | 10/1966 | Projahn | 431/131 |
| 3,447,882 | 6/1969 | Newman | 431/131 |
| 3,533,718 | 10/1970 | Shuto | 431/277 |

*Primary Examiner*—Carlton R. Croyle

*Assistant Examiner*—L. J. Casaregola

*Attorney, Agent, or Firm*—Pennie & Edmonds

[57] ABSTRACT

A lighter of the disposable type is disclosed for burning a fuel such as butane contained in a body member which defines an internal fuel chamber having an opening through which the fuel may pass and including a dual action valve which controls the flow of gaseous butane fuel to a burner in either of two modes. The first mode includes an "on/off" fuel control lever; the second mode includes a variable fuel flow control member which determines the height of the flame produced at an output orifice of a burner by a sparking wheel and sparking flint by controlling the amount of fuel passed therethrough as a function of the rotational position of a rotatable control member. The lighter further comprises novel means to pre-determine the height range of the flame thus produced, by limiting the rotational range of travel of the flame height control member.

9 Claims, 6 Drawing Figures

LIGHTER

BACKGROUND OF THE INVENTION

1. Field of the Invention

This invention relates to adjustable lighters which consume fuels, such as butane, by coverting them to a gaseous state and burning them. More particularly, the invention relates to a novel apparatus for controlling the range through which the fuel consumption rate may be adjusted.

2. Description of the Prior Art

Various prior art lighters, some of them including means for varying the height of the flame produced by the lighter by controlling the rate at which fuel is consumed, and some of them further including means for limiting the range through which the flame may be adjusted, are known. However, these devices also have a number of known deficiencies which limit their use. Many of the mechanisms are rlatively complicated and therefore suffer from the twin disabilities of a high manufacturing cost as well as a relatively high likelihood of mechanical failure during use. Another disadvantage of some of these devices is the fact that the particular construction limits the shape of the lighter housing due to the fact that the housing must be large enough to accommodate the adjustment mechanism.

Still another major deficiency of present day devices pertains particularly to their attempts at controlling the flame heights within pre-selected ranges. In the absence of a positive reliable means for controlling the flame height range — particularly the maximum flame height — these lighters present an ever existing hazzard to consumers who may suffer skin burns caused by a flame having an unexpected excessive height.

A typical adjustable lighter is disclosed in U. S. Pat. No. 3,280,599 to Projahn. In this patent the height of the flame is varied by rotating an adjustment screw which is coupled to a rotary valve. The rotation of the valve is limited by a toothed element, only a portion of which has teeth cut into it. The toothed element is secured to the adjustment screw and held in position by friction. The toothed element is in turn coupled to a gear which is mounted for rotation adjacent the valve adjustment screw. Due to the fact that only a portion of the toothed element contains teeth, the valve adjustment screw which is coupled to the toothed element is only free to rotate through angular positions in which the teeth of the toothed element are in contact with the teeth of the gear. Thus while the motion of the adjustment screw is limited to a certain range, this device nevertheless suffers from several disadvantages. In order to permit the setting of a general range, the coupling between the toothed element and the adjustment screw is one which will slip when a minimum magnitude of force is applied. Thus, it is likely that with wear or with time or simply with excesssive force, the size of the flame may vary out of the desired range, causing several problems. For example, if the valve setting is too low, the lighter will not ignite. Likewise, if the valve setting is too high, a user actuating the lighter while it is next to his face is likely to be injured by an excessively large flame.

An alternative method of limiting the angular displacement of the adjustment screw on the lighter is disclosed in U. S. Pat. No. 3,213,648 to Racek. In this patent the desired adjustment range limitation is achieved by providing a stop hump on the top of the lighter and providing a toothed disk which has had one of its teeth bent into the path of the stop to serve as a co-operating stop. This device has a number of disabilities which limit its usefulness. If the toothed disk is to properly serve its additional function of an operating knob, it must have a minimum physical strength. If it has this minimum physical strength, it then becomes relatively difficult to bend the tooth. If on the other hand, the disk is made with a bent tooth, it is not possible to select a tooth and thus select a given range. Still another disadvantage is that some modification of existing equipment must be made in order to manufacture a case having the desired stop hump.

U. S. Pat. Nos. 3,208,244 to Mandy and 3,161,034 to Meyers both include constructions where the desired range limiting function is done by a combination which includes an inner toothed wheel, an outer washer which has teeth along its inner circumference which mate with the teeth of the inner wheel and special range limiting structure. This structure is relatively expensive to manufacture and includes the further disadvantage of requiring a rather specialized lighter construction in order to accommodate the range limiting mechanism. The lighters disclosed in these patents therefore cannot be made with conventional manufacturing equipment without major retooling and its attendant additional expense.

Still another lighter design which includes a limiting structure is disclosed in Japanese Pat No. 3,248,906 to Tomojiro Zaima. This design includes an adjustable finger wheel which includes a stopper for limiting rotary movement. However, the nature of this limiting structure is such that control of the range through which the lighter may be adjusted is relatively difficult.

The following patents also relate to lighters using butane fuel and the like

U. S. Pat. No. 3,184,931 to Zenzaburo Yoshino
U.S. Pat. No. 3,251,202 to A. Racek
U.S. Pat. No. 3,263,456 to L. S. Dexter
U.S. Pat. No. 3,314,252 to Yoshio Kanamaru
U.S. Pat. No. 3,382,028 to Sadao Yoshinaga
U.S. Pat. No 3,402,963 to L. S. Dexter
U.S. Pat. No. 3,414,364 to A. Bert
U.S. Pat. No. 3,423,160 to J. Genoud
U.S. Pat. No. 3,447,882 to S. H. Newman
U.S. Pat. No. 3,589,851 to Peter Rabe
U.S. Pat. No. 3,597,140 to Peter Rabe
U.S. Pat. No. 3,854,862 to M. E. Webster While these patents relate to various developments in such devices, none of them relate to a lighter having the novel construction and safe, reliable flame height control such as I have invented.

SUMMARY OF THE INVENTION

A lighter for burning a fuel of a type capable of being converted to a combustible gas upon being permitted to expand under atmospheric pressure is disclosed. The lighter comprises a body member defined an internal chamber for containing a supply of fuel. The fuel chamber defines a fuel supply opening through which the fuel may pass. Stem means is provided for defining an output orifice which is communicable with the fuel supply opening in such a manner that fuel permitted to pass through the fuel supply opening is directible to the stem means for projecting a flame from the output orifice. Selectively operable fuel valve means is positioned and structured for selective movement from a first position which seals the fuel supply opening and prevents fuel from passing therethrough to a second position which permits fuel to pass from the fuel supply opening to the output orifice, fuel expansion control means being positioned intermediate said internal chamber and said stem means constructed of a material which is constructed and adapted for selectively varying the fuel permitted to pass through said fuel supply opening, independent of said selectively operable fuel valve means to vary the height of the flame produced by the expansible fuel in proportion to the amount of fuel permitted to pass. A rotatably mounted control member connected to the fuel expansion control means adjusts the fuel expansion control means in proportion to the angular position of the control member with the control member being rotatable from a first limit position which substantially completely restricts expansion of fuel from the fuel supply opening to the output orifice, to a second limit position which permits relatively unrestricted fuel expansion through the fuel supply opening. A limit member which is connected for rotation with the control member has at least one limit stop in the form of a leg member positioned and dimensioned to engage a wall portion of the body member, or an extension thereof, to limit at least the maximum amount of fuel permitted to expand through the fuel expansion control means when the fuel valve means is in the open position, thereby limiting the maximum flame height to a predetermined value. Preferably the limit member is in the form of a thin metallic U-shaped member.

In the preferred embodiment, the rate of flow of this gaseous fuel is controlled by a dual-action valve disposed in the main body,. This valve has two controls. The first control comprises a fibrous washer which is adjustably compressed and through which the gaseous fuel must pass. This control thus has the effect of regulating the amount of fuel which is allowed to pass through the washer. A second control comprises a plug which is used for turning the fuel supply on and off.

Adjustable compression of the fibrous washer is accomplished by seating the washer in a cavity in the base of the valve and compressing the washer between the seat in the cavity and a valve operator which is threadedly mounted in the cavity. A toothed thumbwheel is secured to the operator for rotation therewith to allow adjustment of the operator. Control of the range through which the thumbwheel may be adjusted is accomplished by the aforementioned limit member connected for rotation with the thumbwheel by a tab which may be conveniently bent upwardly into a groove defined between adjacent teeth of the thumbwheel. When the tab is so bent into one of the grooves in the thumbwheel, the limit member is thus forced to rotate along with the thumbwheel.

Opposite the tab portion, the limit member includes at least one leg member which is configured and dimensioned to engage at least one stop means extending upwardly from the side walls when the thumbwheel is rotated to its maximum position. The main body of the lighter is in turn provided with stop means which extends from the side wall and combines with the leg members to obstruct excessive rotation of the limit member and the thumbwheel coupled thereto. Preferably, this stop means is in the form of an extension of the sidewalls, the extensions serving the additional purpose of supporting other components of the lighter. The main body of the lighter is of the type included in lighters currently being marketed which do not have range controls, making the invention particularly useful for adapting conventional lighter manufacturing operations to the manufacture of such lighters with flame size range limits.

Thus, the limit member has the effect of limiting the range through which the thumbwheel, and hence the length of the flame produced by the lighter, may be adjusted. Furthermore, this range may be most accurately and conveniently controlled by selection to the proper groove into which the tab of the limit member is bent. Thus, in the manufacture of a lighter, one would adjust the lighter to the proper position and then simply bend the tab into the proper groove.

It is thus seen that the lighter constructed in accordance with the present invention including the range limiting mechanism disclosed, has several advantages over prior art lighters. The construction, being relatively less complex than existing lighters, results in both economy and dependability as will be seen. The range limiting structure of the lighter is simultaneously both inexpensive and relatively easy to set to any desired range. Still another advantage of the instant lighter is that it may be used in conjunction with conventional lighters without extensive retooling of the manufacturing equipment because existing lighters may be modified to incorporate the inventive features without major structural redesign.

DETAILED DESCRIPTION OF THE PREFERRED EMBODIMENTS

Figure 1:
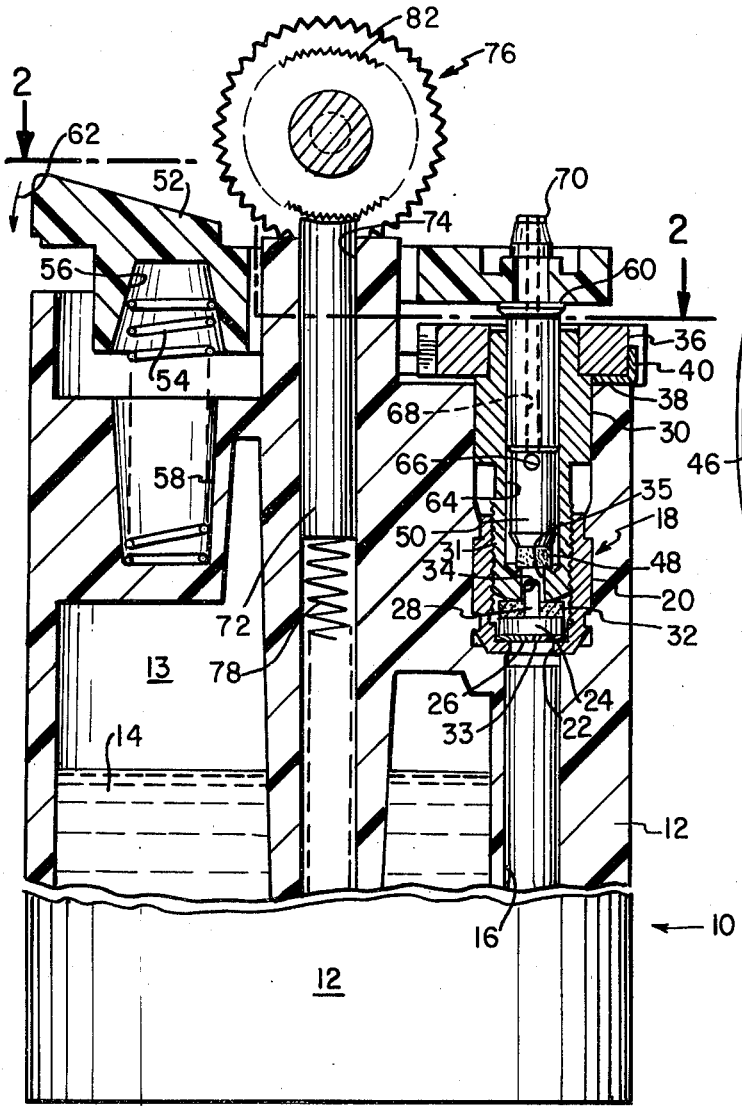
FIG. 1 is a cross-sectional view of a lighter constructed in accordance with the present invention.
Figure 2:
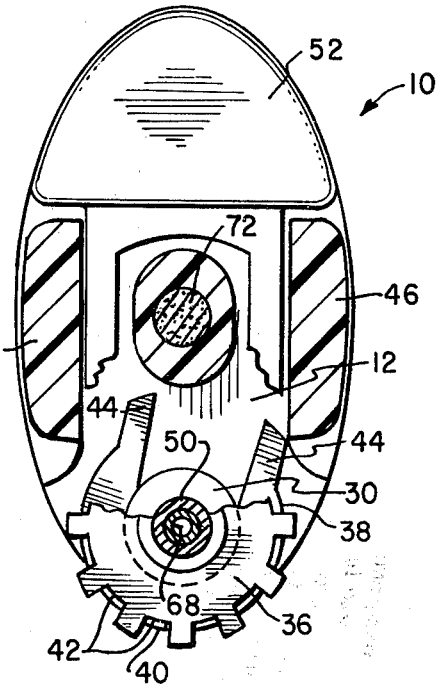
FIG. 2 is a cross-sectional view along lines 2—2 of FIG. 1.

Referring initially to FIGS. 1 and 2, the lighter 10 of the present invention includes a main body 12 which is constructed of a suitable structural material, and preferably a plastic material such as polypropylene, polyethylene, nylon and the like. The main body 12 defines an internal chamber 13 which is filled with butane fuel 14 capable of vaporizing in a conventional manner to produce a gaseous medium which passes through a bore of fuel supply duct 16 under the control of a dual action valve 18.

Valve 18 comprises a valve base 20 which defines a bore 22 configured to admit fuel vaporized from bore 16 to the valve. Disc-like support member 24, having a plurality of radial notches 33 on the lower surface, is seated within valve base 20. A shaftlike stem 28 extends upwardly from the upper surface portion of the support member 24 and fits loosely within a bore 35 defined by a valve operator 30 which is threadedly mounted within valve base 20. A pressure regulated washer 32 constructed of a fibrous material is positioned about the stem 28. Washer 32 may be constructed of any porous material whose porosity varies in dependence upon compressive forces applied thereto, such that gaseous fuel will pass through the washer in amounts correspondingly dependent upon compressive forces acting upon the washer. When the washer is uncompressed, a maximum amount of gaseous fuel passes therethrough and when the washer is substantially fully compressed it blocks the passage of fuel therethrough. Although fibrous materials such as felt are contemplated for use in the inventive lighter herein, exceptional results have been obtained using washers of nylon fibrous material of the type marketed under the trade name NOMEX by E. I. du Pont de Nemours & Co., of Wilmington, Delaware. This material — in addition to being porous — has an excellent memory when compressed such that when the pressure is released, the washer returns to its original porour condition.

The amount of gaseous fuel passing into bore 34 is dependent upon the pressure exerted on porous fibrous washer 32 by the lower portion 31 of valve operator 30 when valve operator 30 is threadedly advanced into or withdrawn from valve base 20. Valve operator 30 is rotated and thereby advanced into, and withdrawn from, valve base 20 through the rotation of a rotatably mounted control member in the form of a toothed thumbwheel 36 secured to valve operator 30. Thus the angular position of thumbwheel 36 determines the compressive forces acting on washer 32 to thereby control the amounts of fuel vaporized therethrough.

Figure 3:
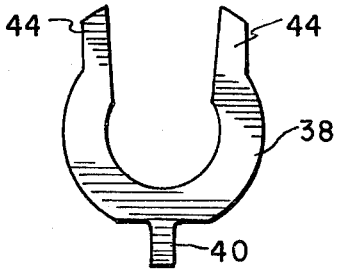
FIG. 3 is a plan view of the limit member used in the lighter illustrated in FIGS. 1 and 2.

A finger activated lever 52 is pivotally mounted between side wall portions 46 which are shown in FIG. 3 and which comprise extensions of the side walls of body 12. The lever 52 is attached to hollow stem 50 slidably supported within valve operator 30. Stopper 48 — which is constructed of an elastomer material such as a synthetic or natural rubber material — is secured to the lower end portion of hollow stem 50. A spring 54 is compressed within a recess 56 in lever 52 and engages seat 58 in valve body 12 while the forward portion engages lip 60 on hollow stem 50 which in turn urges seals stopper 48 against bore opening 34 to prevent fuel from expanding therethrough when the lighter in not in use.

Lighter 10 also includes a sparking flint 72 mounted within a bore 74 in main body 12. Flint 72 is urged toward a sparking wheel 76 by spring 78. Sparking wheel 76 — which includes a toothed surface which is preferably suitable hardened — is mounted for rotation between side wall extension portions 46 in a conventional manner. The sparking wheel includes suitable indentations which define teeth 82 such that when the wheel is rotated, the toothed surface slides against flint 72 causing the generation of ignition sparks.

In accordance with the preferred embodiment of the invention, limitation of the thumbwheel's movement is accomplished by coupling a limit member 38 to the thumbwheel. Limit member 38 is preferably of a generally U-shaped metal construction configured as shown in FIG. 3 to snappingly embrace valve operator 30 as shown in FIGS. 1 and 2. Limit member 38 includes a locking tab 40 with parallel leg members 44. After assembly of the basic lighter structure, the lighter is preset within a given range by adjusting the thumbwheel to the desired position. Limit member 38 is inserted immediately below the thumbwheel causing it to snappingly embrace valve operator 30. Tab 40 is then bent upwardly into an adjacent depression 42 between the teeth of the thumbwheel 36 to lock the thumbwheel within the desired range. Rotational displacement of thumbwheel 36 is thus limited by leg members 44 of member 38 bearing against wall portion extensions 46 of the sidewalls of the maain body 12 of the lighter, as is illustrated most clearly in FIG. 2.

In operation, it is desirable in using the lighter to rotate sparking wheel 76 and immediately thereafter to depress lever 52 using a single motion of the thumb. An extension for supporting a flame defines an orifice 70 as shown. The sparks thus produced ignite the gaseous fuel which is permitted to be expelled from orifice 70 when lever 52 lifts hollow stem 50 thereby removing elastomer stopper 48 from the bore 34. The lifting action of lever 52 relieves the pressurized condition in the fuel chamber thereby permitting the butane fuel 14 to form a gaseous medium which passes through radial notches 33 around disc-like member 24 and through the compressible fibrous washer 32 up to orifice 70 to be burned. The amount of gaseous fuel passing into bore 34 is determined by the pressure exerted on porous fibrous washer 32 and this pressure, in turn, is determined by the threadedly advanced position of valve operator 30 into valve base 20 as explained previously. Since the height of the flame extending from orifice 70 is in turn, determined by the amount of gaseous fuel passing therethrough, — while lever 52 provides a first "on/off" fuel control — thumbwheel 36 thus provides the second control feature of dual action valve 18 to determine the length of the flame of the lighter.

Since the angular position of thumbwheel 36 is thus proportional to the fuel being consumed by the lighter and hence the length of the flame produced by the lighter, the size of the flame height is thus maintained within a pre-selected range by permitting the thumbwheel to be rotated only within a given preselected range of angular positions which correspond to the desired range of flame length. This pre-selected angular range of the thumbwheel in turn is determined by the limit member 38 because leg members 44 engage their respective adjacent wall protions 46 of body member 12 to prevent further rotation of the thumbwheel in either direction beyond the pre-selected range.

It can be seen that an inventive feature of the limit member 38 of the present inventive lighter pertains to its adaptability in retrofitting existing lighters for correspondingly pre-setting valve devices which permit expansion of a gaseous medium in proportion to pre-determined flame height requirements of the manufacturer. By centering the rotational position of the thumbwheel of a gaseous control valve of a lighter of the type disclosed herein, a limit member 38 may be configured to be snappingly engaged about an operator member such as at 30, the operator being positioned immediately below the thumbwheel and in face-to-face relation with its lower surface as shown in FIG. 2 of the present invention. By bending the tab 40 upwardly between adjacent teeth of the thumbwheel which are suitably centrally positioned relative to the pre-selected flame height range, rotation of the thumbwheel will be limited by the ultimate engagement of leg member 44 against vertical wall portions of the lighter which are positioned in the immediate vinicity of the thumbwheel. Compression and decompression of the fibrous washer it thus seen to be limited within the pre-selected range such that the minimum or maximum height of the flame (or both) may be pre-determined, thus maintaining such lighters safe for consumers.

Figure 4:
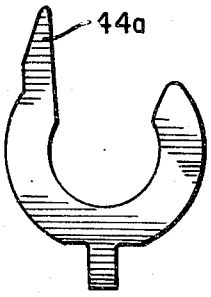
FIGS. 4—6 are plan views of alternative limit members which may be employed in place of the limit member illustrated in FIG. 3 in the lighter illustrated in FIGS. 1 and 2.
Figure 5:
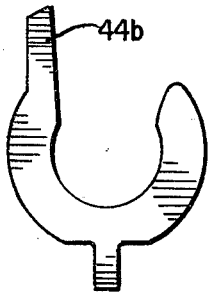
Figure 6:
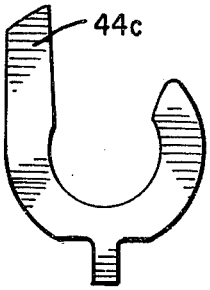

The particular embodiment of the invention illustrated in FIGS. 1–2 and using the limit member illustrated in FIG. 3 has a relatively small range of adjustment. This range may be increased by substituting the limit members illustrated in FIGS. 4–6. The member of FIG. 4 will give the greatest range of flame height. The member illustrated in FIG. 5 gives a slightly smaller range and finally the member illustrated in FIG. 6 will give a range less than the member of FIG. 5 but greater than the member of FIG. 3. This added range is due to the shape of extensions 44*a–c* and also due to the fact that the members have only one extension. It is also noted the range of the lighter using a limiting member such as that illustrated in FIG. 3. may be further varied by substituting extensions 44*a* or 44*c* for one or both extensions 44.

What is claimed is:

1. A lighter for burning a fuel of a type capable of providing a combustible gas upon being permitted to expand under atmospheric pressure which comprises:

a. a body member defining an internal chamber for containing a supply of fuel, said fuel chamber further defining a fuel supply opening through which the fuel may pass;

b. an extension positioned on said body member and defining an output orifice which is communicable with said fuel supply opening in such a manner that fuel permitted to pass through said fuel supply opening is directable to said extension for projecting a flame from said output orifice;

c. selectively operable valve means positioned and structured for selective movement from a first position which seals said fuel supply opening and prevents fuel from passing therethrough to a second position which permits fuel to pass from said fuel supply opening to said output orifice;

d. fuel expansion control means positioned intermediate said internal chamber and said extension and constructed of a material which is structured and adapted for selectively varying the fuel permitted to pass through said fuel supply opening, independent of said selectively operable fuel valve means, to vary the height of the flame produced by said expansible fuel in proportion to the amount of fuel permitted to pass;

e. a rotatably mounted control member defining a plurality of radial extending teeth about the periphery, said control member being operatively connected to said fuel expansion control means to adjust the fuel expansion control means in relation to the angular position of the control member with the control member being rotatable from a first limit position which substantially restricts expansion of fuel from said fuel supply opening to said output orifice and a second limit position which permits relatively unrestricted fuel expansion through said fuel supply opening; and f. at least one limit member positioned about said control member and having deformable tab means bendable between at least two of said radial extending teeth to prevent selective relative rotary movement of said limit member and control member while causing said limit member to rotate therewith, said limit member having at least one leg member positioned and dimensioned to engage a wall portion of said body member to limit at least the maxium amount of fuel permitted to expand through said fuel expansion control means when said fuel valve means is in the open position.

2. A lighter as in claim 1 wherein said limit member is configured to be snappingly mounted for rotation with said control member.

3. A lighter as in claim 1, wherein said rotatably mounted control member is a thumbwheel which has a plurality of teeth disposed around its periphery and depressions disposed between said teeth, and said tab means is bent into one of said depressions.

4. A lighter as in claim 3, wherein said limit member is generally U-shaped and said leg member is engageable with a wall portion of the main body of the lighter.

5. A lighter as in claim 4, wherein said fuel expansion control means comprises a member constructed of porous fibrous material.

6. A lighter as in claim 5, wherein said fuel expansion control means comprises a compressible washer constructed of a nylong fibrous material in such a manner that compression of the material prevents the passage of gaseous fuel therethrough and release of the pressure permits the material to return to its original structure to permit relatively unrestricted fuel passage therethrough.

7. A lighter as in claim 1, wherein said fuel expansion control means comprises:

a. valve base means defining a cavity;

b. bore means pneumatically coupling one end of said cavity of said fuel supply opening;

c. a seat disposed as said one end of said cavity;

d. adjustable operator means threadedly mounted in and extending from the other end of said cavity and having a passage in communication with said cavity, said passage putting said fuel supply opening in communication with said output orifice of said flame supporting extension; and e. compressible means disposed in said cavity between said adjustable operator and the seat of said valve base means for selectively regulating the escape of fuel from said fuel supply opening to said passage.

8. A lighter as in claim 5, further comprising plug means for stopping the escape of fuel from said passage.

9. A lighter as in claim 7, wherein said valve further comprises a support member disposed in said seat, said support member having notches at its bottom and a stem extending from its top into said passage in said adjustable operator, said stem being smaller in size than said passage and wherein said compressible means is a porous washer disposed around said stem between said support member and said adjustable operator means.

* * * * *

UNITED STATES PATENT AND TRADEMARK OFFICE

CERTIFICATE OF CORRECTION

PATENT NO. : 4,036,579

DATED : July 19, 1977

INVENTOR(S) : William E. Marynissen

It is certified that error appears in the above-identified patent and that said Letters Patent are hereby corrected as shown below:

Column 1, line 7, "coverting" should read -- converting --

Column 2, lines 58-59 "The fuel chamber defines" should read -- The fuel chamber further defines --

Column 4, line 7, "selection to the" should read -- selection of the --

Column 5, line 65, "maain" should read -- main --

Column 6, line 33, "protions" should read -- portions --

Column 8, line 23, "nylong" should read -- nylon --

Column 8, line 34, "disposed as said" should read -- disposed at said --

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*